United States Patent [19]

Cameron

[11] 4,175,295

[45] Nov. 27, 1979

[54] WATER SAVING TOILET

[76] Inventor: Robert L. Cameron, 6106 Seminole St., Berwyn Heights, Md. 20740

[21] Appl. No.: 918,109

[22] Filed: Jun. 22, 1978

[51] Int. Cl.[2] ..... E03D 1/14

[52] U.S. Cl. ..... 4/327; 4/249; 4/412; 4/415

[58] Field of Search ..... 4/327, 326, 325, 413, 4/415, 249, 405, 412

[56] References Cited

U.S. PATENT DOCUMENTS

| | | | |
|---|---|---|---|
| 3,768,103 | 10/1973 | Robinson | 4/326 |
| 3,918,105 | 11/1975 | Young | 4/326 |
| 4,042,982 | 8/1977 | Contreras | 4/326 |
| 4,056,856 | 11/1977 | Reid et al. | 4/326 |

*Primary Examiner*—Lenard A. Footland

*Attorney, Agent, or Firm*—Blair, Brown & Kreten

[57] ABSTRACT

Disclosed herein is a water saving toilet characterized in that a single handle actuates either of two water sealing valves horizontally offset one from the other and when actuated makes it possible to vary the amount of water introduced into the bowl so that a lesser amount of water can be used to evacuate urine.

6 Claims, 3 Drawing Figures

WATER SAVING TOILET

BACKGROUND OF THE INVENTION

With water reserves being depleted through adverse climatic conditions and with an increasing awareness for conservation, structures associated with toilets for conserving water have become increasingly more prevalent and fashionable. Prior art of which this writer is aware includes the following patents:

| | |
|---|---|
| 3,916,455 Lougdin | 4,030,508 Morgan |
| 3,939,507 Clark | 4,025,967 Walker |
| 4,003,097 Book | 4,038,707 Cass |
| 4,011,604 Goldsworthy | |

These patents can be generally broken down into two classifications: those which use dual valve means and either provides two handles for their activation or one and second type wherein a single ball stopper is capable of being replaced on its seat prior to complete evacuation of the water reservoir.

These devices when contrasted with the instant application can be seen to be relatively poorly engineered by comparison by noting the excessive amount of hardware associated with the structure, and/or by noting the problems associated with assuring the flush balls be aligned when energization has been completed.

In any event, none of these references provides the teachings which contemplate the specific structure as set forth hereinbelow and claimed.

SUMMARY OF THE INVENTION

Accordingly, an object of this invention contemplates providing a toilet flushing apparatus which is inexpensive to make, requires few moving parts, and is reliable.

Another object of this invention contemplates providing an apparatus for providing a plurality of flushing levels which can easily be adapted to existing toilet structure.

An additional object of this invention is to provide a ball return valve which is reliable in operation and capable of sure seating after each use.

These and other objects will be made manifest when considering the following detailed specification and drawings.

DESCRIPTION OF THE PREFERRED EMBODIMENT

Figure 1:
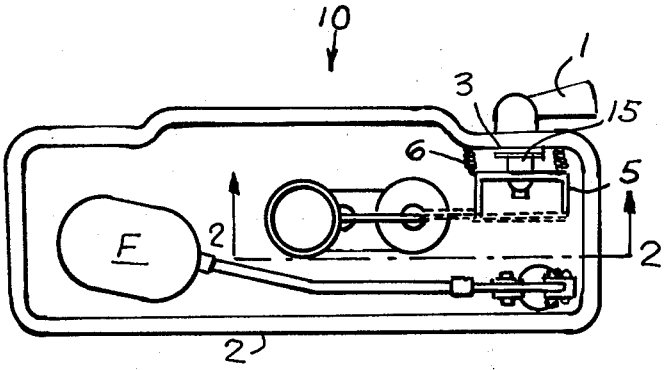
FIG. 1 is a top plan view of the apparatus according to the present invention.

Referring to the drawings now wherein like reference numerals refer to like parts throughout the several drawings, reference numeral 10 is generally directed to the water saving toilet according to the present invention.

This water saving device can generally be regarded as having an mechanism disposed within a conventional water reservoir 2 having a handle 1. Handle 1 is supported by shaft 3 and extends into the tank being sealed from the outer portion of the tank by a washer 15. Shaft

3 terminates at the extremity remote from the handle 1 in a lever 4 which is centered on the shaft 3. Connected at the extremities of lever 4 are chains 7 biased by spring means 6. Connected to the chains 7 at their extremities remote from lever 4 are a pair of horizontally offset flush balls 14. It is to be noted that the connection between lever 4 and chains 7 are aided by ear members 5. The balls 14 are pivoted about a vertical water column 11 through rod members 9, and communicate with the water evacuation column 11 through horizontally outwardly extending conduits 13.

The seating of the conventional ball 14 is effected by the bottom curved portion 8 of the ball nesting against sealing rim 12. The portion of conduit 13 proximate to the water evacuation column 11 has an upwardly flared portion 16 extending approximately 45% from the horizontal so as to provide a sure nesting lip 12 in coaction with surface 8.

Figure 2:
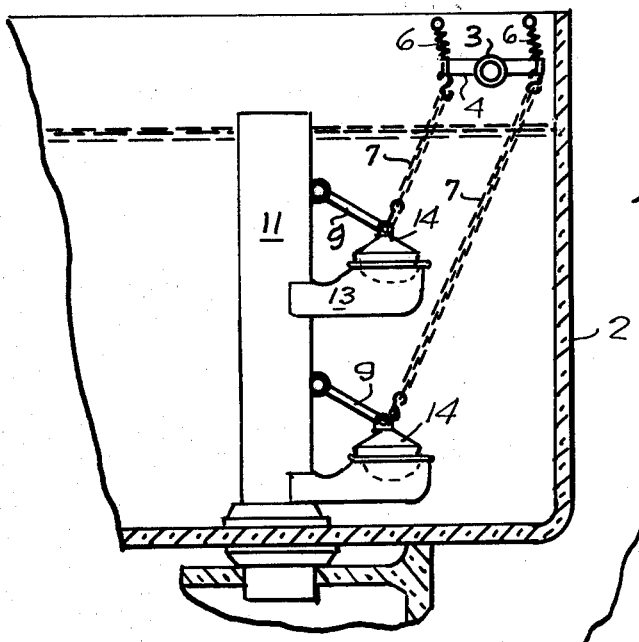
FIG. 2 is a side view thereof taken through a section of the toilet water reservoir.
Figure 3:
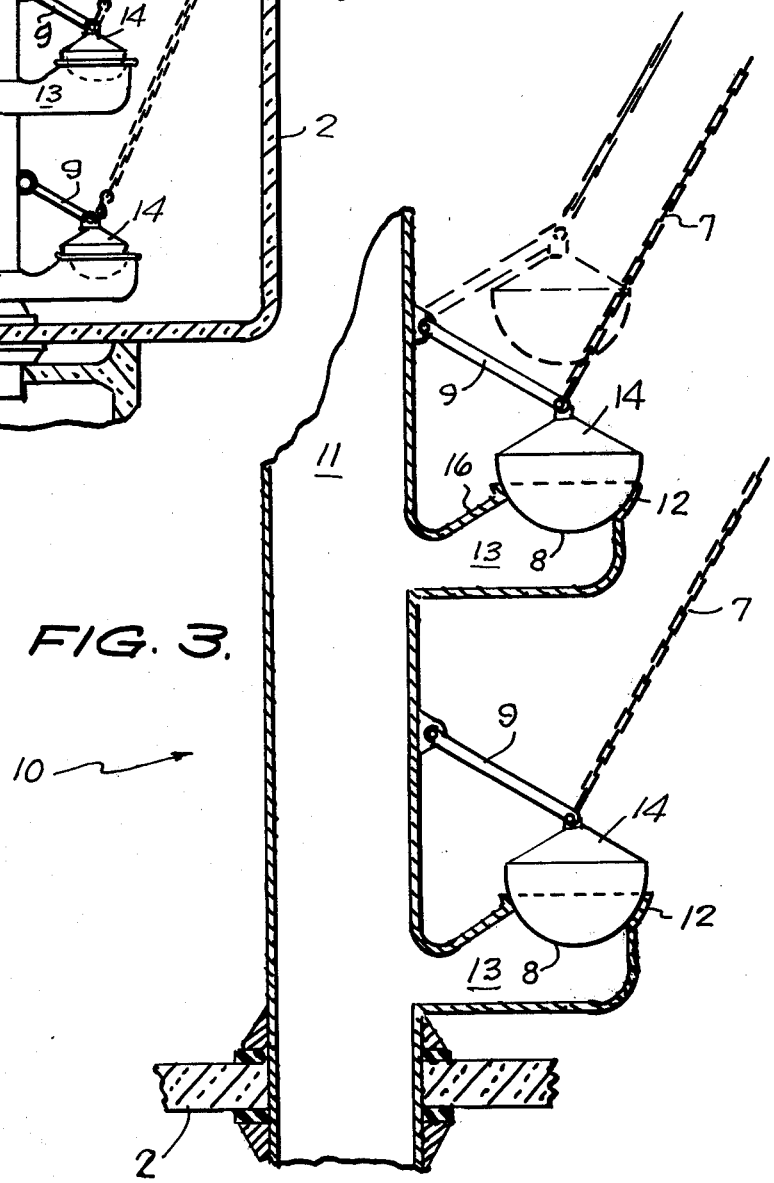
FIG. 3 shows an exploded parts detail of the flushing mechanism according to the present invention.

The structure will now be described in its usage: looking at FIG. 2, when lever 4 is rotated in a clockwise fashion, the shorter upper chain 7 will become tensioned and the lower chain 7 will become slackened. When this occurs of course the upper ball 14 will be removed from its seat and evacuation of the water to that level will take place. This would approximate a situation in which a somewhat moderate ingress of water into the commode bowl was desirable. The alternative situation however would be when lever 4 is rotated in the counter clockwise direction in which upper chain would then be slackened and lower chain 7 would be tensioned, thereby opening lower flush ball 14 and providing a greater volumn of water to extend into the commode bowl. The configuration of evacuation column 11 where it meets conduit 13 is such that an initial larger area proximate to the lower portion of the flush ball admits somewhat larger volumn of water than actually can be admitted into the evacuation column 11 since the conduit 13 tapers somewhat at its juncture with 11. This has a net affect of increasing the velocity of the water through a nozzle type affect and makes the water entering into the commode bowl arrive at a somewhat higher velocity then would be possible without the nozzle effect.

Water of course is restored to the reservoir 2 through conventional plumbing means float F as shown in FIG. 1.

Having thus described the invention it will be apparent that numerous structural modifications are contemplated as being a part of this application in spirit and scope as detailed hereinabove and specified in the claims. Further however terminology horizontally offset is intended to define a pair of flush balls each in a different horizontal plane but one vertically higher than the other. This is similarly true for the upper and lower conduits 13 and rods 9.

What is claimed is:

1. A water saving mechanism for a toilet reservoir comprising a water evacuation column connected to a commode, a pair of conduit means communicating with said column and horizontally offset one from the other, valve ball means removeably nested within said conduit means, and linkage means connected to said valve ball means for selectively removing one of the two valve balls so as to provide different volumes of water into the commode bowl by virtue of the different vertical heights of said conduits in which said linkage means includes an upper and lower chain, the upper chain being connected to the upper valve ball, the lower chain being connected to the lower valve ball, and a single lever connected at opposed extremities to the terminal point of each of said chains whereby rotation of said lever in a clockwise direction will actuate one valve ball and rotation of the said lever in the opposite direction will actuate said other valve ball and in which said chains are connected to said lever through ears and in which said lever is spring biased at the opposed extremities so as to return said lever to an initialized state.

2. The device of claim 1 in which said conduit means are provided with a taper so as to accelerate the water flow when the flow goes through said conduit and into said column.

3. The device of claim 2 in which said conduits are provided with an upper portion proximate to said water evacuation column having a taper of approximately 45% relative to the horizontal.

4. The device of claim 1 in which said valve balls are each pivotally connected to said water evacuation column by rod means so as to cause said valve balls to rotate and return to said conduits.

5. The device of claim 1 in which said conduit means are provided with a rim portion which can nest with the sealing portion of said valve ball.

6. The device of claim 1 in which said lever is supported on a shaft which extends through the water reservoir and terminates in an handle orthogonally offset from said shaft and sealing means are provided on said shaft at said reservoir to discourage water flow outwardly therefrom.

* * * * *